US007873433B2

(12) United States Patent
Böck et al.

(10) Patent No.: US 7,873,433 B2
(45) Date of Patent: Jan. 18, 2011

(54) PRODUCTION OPTIMIZATION USING DATA RECEIVED FROM A REMOVABLE COMPONENT

(75) Inventors: Karl Josef Böck, Heidenheim (DE); Herbert Schrefl, Pölten (AT); Peter Putschögl, Wimpassing (AT); Georg Gobec, Wiener Neustadt (AT); Norbert Gamsjäger, Bad Fischau (AT)

(73) Assignee: Voith Patent GmbH, Heidenheim (DE)

( * ) Notice: Subject to any disclaimer, the term of this patent is extended or adjusted under 35 U.S.C. 154(b) by 1098 days.

(21) Appl. No.: 11/560,415

(22) Filed: Nov. 16, 2006

(65) Prior Publication Data

US 2007/0169060 A1 Jul. 19, 2007

Related U.S. Application Data

(63) Continuation of application No. PCT/EP2005/052218, filed on May 13, 2005.

(30) Foreign Application Priority Data

May 19, 2004 (DE) ..... 10 2004 024 737

(51) Int. Cl.
*G06F 19/00* (2006.01)
*G06F 7/66* (2006.01)

(52) U.S. Cl. ..... 700/128; 700/97; 700/100; 700/127; 162/109; 162/258; 162/263

(58) Field of Classification Search ..... 700/97, 700/100, 127, 128; 162/109, 258, 263
See application file for complete search history.

(56) References Cited

U.S. PATENT DOCUMENTS 5,592,875 A * 1/1997 Moschel ..... 100/99
6,257,953 B1 * 7/2001 Gitis et al. ..... 451/5
6,264,533 B1 * 7/2001 Kummeth et al. ..... 451/8
6,473,670 B1 * 10/2002 Huhtelin ..... 700/128
6,722,948 B1 * 4/2004 Berman ..... 451/21
7,606,741 B2 * 10/2009 King et al. ..... 705/27

(Continued)

FOREIGN PATENT DOCUMENTS

DE 199 10 197 3/1999

OTHER PUBLICATIONS

"Simulation-Based shop floor control; formal model, model generation and control interface", Son et al, System and Industrial Engineering Department, The University of Arizona, IEEE, Feb. 2001.*

*Primary Examiner*—Michael D Masinick
(74) *Attorney, Agent, or Firm*—Taylor IP, P.C.

(57) ABSTRACT

This invention relates to a system and a method for optimization of the process performance of a web-processing machine, in particular a machine for the production or further processing of paper, paperboard or tissue, including the following steps: storage of specific data of a component on a data storage unit fitted to the component; and/or measurement of relevant properties of the component by way of a sensor unit fitted to the component; sending of the specific data and/or the measured relevant properties to an open-loop control unit and/or a closed-loop control unit; and optimization of the process performance by way of the open-loop control unit and/or the closed-loop control unit using specific data and/or the measured properties of the component.

27 Claims, 2 Drawing Sheets

U.S. PATENT DOCUMENTS

| | | | | |
|---|---|---|---|---|
| 7,714,723 | B2 * | 5/2010 | Fowler et al. | 340/572.1 |
| 2002/0179270 | A1 | 12/2002 | Gustafson et al. | 162/263 |
| 2003/0010460 | A1 | 1/2003 | Grabscheid | |
| 2003/0027424 | A1 * | 2/2003 | Paik | 438/692 |
| 2005/0109587 | A1 | 5/2005 | Best et al. | 198/810.01 |
| 2005/0197044 | A1 * | 9/2005 | Bolz | 451/5 |
| 2007/0032170 | A1 * | 2/2007 | Halley et al. | 451/6 |
| 2008/0004743 | A1 * | 1/2008 | Goers et al. | 700/121 |
| 2008/0297322 | A1 * | 12/2008 | Krener et al. | 340/10.4 |
| 2010/0134257 | A1 * | 6/2010 | Puleston et al. | 340/10.4 |

* cited by examiner

PRODUCTION OPTIMIZATION USING DATA RECEIVED FROM A REMOVABLE COMPONENT

CROSS REFERENCE TO RELATED APPLICATIONS

This is a continuation of PCT application No. PCT/EP2005/052218, entitled "Production Optimization", filed May 13, 2005.

BACKGROUND OF THE INVENTION

1. Field of the Invention

This invention relates to a production optimization system for a web-processing machine, in particular a machine for the production or further processing of paper, paperboard or tissue. Furthermore, this invention relates to a component, in particular a wearing component of a web-processing machine, which can be used in conjunction with the production optimization system according to the present invention. In addition, this invention relates to a method for optimizing the production performance of a web-processing machine.

2. Description of the Related Art

On a machine for the production or further processing of paper, paperboard or tissue, use is made of many different types of components that are subject in part to very intensive wear. In the various regions of a paper, paperboard or tissue machine for example, use is made of many different types of skins that have in part very different functions.

In the forming section of a paper machine, for example, forming meshes are used. The object of forming meshes is, among other things, to remove water from the fiber suspension applied thereon and to fix the fibers in their final position.

In the press section, for example, press felts, press belts and transport belts with in part smooth or open surfaces are used. These types of skins are exposed in part to very high pressures.

In the drying section, use is made of so-called dryer fabrics with open surfaces. Dryer fabrics are subject in greater measure to degradation effects on account of the very high temperatures existing in a drying section combined with the high humidity.

Furthermore, rollers such as smoothing rollers or calender rollers are fitted with roller covers made of plastic. In this case the roller covers have functional surfaces of many different types.

Depending on their purpose and their specific operating conditions, the above mentioned components display a different wear behavior. The different wear behavior leads to some in part very different service lives of the components concerned. During operation of the paper machine it is necessary therefore for skins, for example, to be replaced in regular intervals, thus leading to stoppages of the paper machine and hence to production losses.

The service life of the components concerned is defined in this case by the fact that the individual components have become worn and are therefore unusable. However, the service life of the components is limited also by the fact that as from a certain degree of wear they no longer satisfy the higher requirements for the production of certain paper grades.

What is needed in the art is a production optimization system, a component and a method for web-processing machines, by way of which it is possible to increase the productivity of the web-processing machine while maintaining the highest possible quality of the material web.

SUMMARY OF THE INVENTION

According to an embodiment of the present invention, provision is made for the production optimization system to have an open-loop control unit and/or a closed-loop control unit and at least one data storage unit fitted to at least one component of the web-processing machine. In addition, provision is made for specific data of the component to be stored or storable on the at least one data storage unit and for an optimization of the production performance to be possible by way of the open-loop control unit and/or closed-loop control unit using the specific data.

The component is generally a process-influenced component and/or a process-influencing component.

Hence, specific data of components that are relevant for the production planning, for example wearing components, are stored on a data storage unit that is fitted respectively to the components. The data storage unit can be a data storage unit that stores the data in electronic form as well as one on which the data are stored in visual form, for example in the form of a barcode.

In this case the specific data are advantageously data that provide information on the design and/or material and/or date of production and/or date of installation of the component.

In this case design data are understood to mean for example:

- Meshes: weave pattern on the paper side and machine side; properties such as thickness of the mesh, permeability of the mesh, etc.;
- Felts: construction and order of the various layers, weight of the individual layers, etc.; and
- Roller covers: construction, hardness, structure of the surface, etc.

The specific data of the relevant components are sent to the open-loop control unit and/or closed-loop control unit directly or indirectly, i.e. after being evaluated for example. Using the specific data of the various relevant components, the open-loop control unit and/or the closed-loop control unit determines an optimum of productivity. In this case the basis for the optimization by the open-loop control unit and/or the closed-loop control unit is provided by empirical process models for example, by way of which the individual specific data of the individual relevant components are set in relation to each other.

According to another embodiment of the present invention, provision is made for the production optimization system to have an open-loop control unit and/or a closed-loop control unit and at least one sensor unit fitted to at least one component of the web-processing machine. In addition, provision is made for relevant properties of the component to be measurable by the at least one sensor unit and for optimization of the production capacity to be possible by way of the open-loop control unit and/or the closed-loop control unit using the measured properties.

Hence, relevant properties of components that are relevant for the production planning, for example wearing components, are measured by way of a sensor unit that is fitted respectively to the components. The sensor unit can be a piezoelectric sensor or an optical sensor.

The measured relevant properties are advantageously properties that provide information on the wear and/or state and/or remaining life of the component. In the case of roller covers, press felts and press belts for example, pressure measurements are advantageous because pressure measurements permit conclusions to be drawn about thickness, compressibility and hardness and hence the remaining life and process behavior of these components.

The measured relevant properties of the relevant components are sent to the open-loop control unit and/or the closed-loop control unit directly or indirectly, i.e. after being evaluated for example. Using the relevant properties of the various relevant components, the open-loop control unit and/or the closed-loop control unit determines an optimum of productivity. In this case the basis for the optimization by the open-loop control unit and/or closed-loop control unit is provided by empirical process models for example, by way of which the individual relevant properties of the individual relevant components are set in relation to each other.

There are different influencing factors which decide the productivity of a web-processing machine. A first influencing factor are stoppage times caused by maintenance, replacement or repair work. For this reason, an embodiment of the invention provides for the optimization of productivity to be effected by determining stoppage times through use of the specific data of the relevant components and/or through use of the measured relevant properties of the relevant components.

This means, for example, that a variable determination of stoppage times as a factor of the combination of skins on the web-processing machine is possible.

Furthermore, a production cycle can be extended by adhering to the correct order of paper grades to be produced. It makes sense, for example, for a high-quality paper grade not to be produced at the end of a production cycle if, for example, some of the wearing components display notable deviations in their properties from the normal state. However, it also makes no sense for a high-quality paper grade to be produced at the beginning of a production cycle because the wearing components first need to be run in. An embodiment of the invention thus provides for one result of the optimization of productivity to be the determination and coordination of the order of material web grades to be produced.

In addition, the productivity of a web-processing machine can be optimized through the adjustment of process parameters of the web-processing machine. An embodiment of the invention thus provides for the optimization of productivity to be effected through the adjustment of process parameters of the web-processing machine.

According to the present invention, an optimization of productivity is effected through the use of specific data and/or relevant properties of relevant components of the web-processing machine. More information can be drawn on for the optimization. According to an embodiment of the invention, provision is made for the optimization of productivity to be effected through the use of information concerning the time of production and grade of the material webs previously produced and/or through the use of process parameters of the web-processing machine.

If, for example, finished paper webs of a paper machine are identified not only by their charge numbers but also by specific data and/or the measured relevant properties of relevant components, for example the different skins, then it is possible to establish correlations between the quality of the respectively produced paper grade and the respective skin combinations in certain stages of a production cycle, thus obtaining a feedback for the optimization of productivity.

The duration of production cycles is influenced essentially by the life of wearing components. Essential influencing variables for the optimization of productivity of a web-processing machine are therefore specific data and/or relevant properties of wearing components. An embodiment of the present invention thus provides for the component to be a wearing part of the web-processing machine.

In principle, nearly all components of a web-processing machine are subject to certain wear effects. In particular, skins, press belts, rollers and roller covers are exposed to particularly severe wear however. A further aspect of the present invention thus provides for the wearing part to be a skin or a press belt or a roller.

According to an advantageous embodiment of the present invention, provision is made for the production optimization system to include an evaluation unit, wherein the specific data and/or the measured relevant properties can be sent from the at least one data storage unit or the at least one sensor unit to the evaluation unit, and wherein evaluated data based on the received specific data and/or measured relevant properties can be sent from the evaluation unit to the open-loop control unit and/or the closed-loop control unit. According to this embodiment, the specific data and/or the measured relevant properties are processed further in an evaluation unit before the further-processed specific data and/or relevant properties are sent in the form of evaluated data to the open-loop control unit and/or the closed-loop control unit.

According to another embodiment of the present invention, the evaluation unit is an external unit in relation to the web-processing machine.

In addition, an embodiment of the present invention provides for the evaluation unit and the open-loop control unit and/or the closed-loop control unit to form one integral unit.

To reduce the amount of cabling work for installing the inventive production optimization system and to have a free choice in the relative arrangement of the evaluation unit and the at least one data storage unit and/or the at least one sensor unit, it makes sense for the evaluation unit to be able to communicate by wireless ways with the at least one data storage unit and/or the at least one sensor unit. According to another particularly advantageous embodiment of the invention, the production optimization system thus has at least one first send-and-receive unit and one second send-and-receive unit, wherein the at least one first send-and-receive unit is connected to a data storage unit and/or a sensor unit, wherein the evaluation unit is connected to the second send-and-receive unit, and wherein the two send-and-receive units can communicate by wireless ways with each other.

There are different ways in which the wireless communication between the two send-and-receive units can proceed. A preferred embodiment of the present invention provides for the wireless communication to be effected using RFID technology or in accordance with the Bluetooth standard.

For the relevant component, whose specific data and/or whose measured relevant properties are used for the optimization of productivity, to be rendered as insensitive as possible to environmental influences, it makes sense for the first send-and-receive unit and/or the at least one data storage unit to be integrated in the component. In this connection "integrated" is understood to mean that the relevant component and the first send-and-receive unit and/or the at least one data storage unit form one integral unit, meaning that the units are incorporated into the relevant component for example. For example, it is possible for the units to be embedded in the polymer composite structure of a roller cover.

According to an embodiment of the present invention, the at least one data storage unit and the first send-and-receive unit are an integral part of a chip. RFID (Radio Frequency Identification) is a technology which uses a re-programmable transponder chip.

In this case the transponder forms an integral unit from a first send-and-receive unit and a data storage unit in the form of a microchip with antenna embedded in a closed compact geometry. The transponder is particularly insensitive to heat, humidity and dirt and therefore ideally suited for use in web-processing machines such as paper machines.

To prevent marking of the material web to be produced and/or trouble when transporting the material web, it makes sense for the chip to be arranged at the edge of the skin or the press belt or the roller.

For the relevant component, whose specific data and/or whose measured relevant properties are used for the optimization of productivity, to be rendered as insensitive as possible to environmental influences, it makes sense for the at least one sensor unit to be integrated in the component. In this connection "integrated" is understood to mean that the relevant component and the sensor unit form one integral unit, meaning that the units are incorporated into the relevant component for example. For example, it is possible for the sensor unit to be constructed in the form of piezoelectric threads which are woven into the weave structure of a mesh. In this case the piezoelectric threads can extend at least in some areas or entirely across the width and/or length of the mesh.

Another embodiment of the present invention provides for a stationary or mobile peripheral with input unit to be provided and for the second send-and-receive unit and the evaluation unit to be an integral part of the peripheral. A mobile peripheral can be constructed generally as a portable computer with a send-and receive unit and with an evaluation unit, for example in the form of a handheld. A stationary peripheral can be constructed generally as a stationary computer with a send-and receive unit and with an evaluation unit.

According to another embodiment of the present invention, the at least one data storage unit can be programmed by way of the input unit. It is thus possible to re-program the data storage unit repeatedly. This can make sense if the data storage unit is to be re-used for example and be fitted to a new wearing part such as a skin for example.

According to another aspect of the invention, a component of a web-processing machine, in particular a machine for the production of paper, paperboard or tissue is proposed, wherein the component, as one integral part, includes a send unit for sending data, at least one data storage unit for storing specific data of the component and/or at least one sensor unit for measuring relevant properties of the component.

Advantageously the component of the invention is a skin or a press belt or a roller or a roller cover, wherein the skin can be a forming mesh or a press felt or a dryer fabric or a transfer belt.

If the component is a roller for example, then a type of resume of the roller, extending from its production to its operation and scrapping, can be recorded by way of the specific data stored or storable in the data storage unit. The following specific data can be cited as examples:

a) Specific Data Concerning the Production and Shipment of the Roller:

roller ID number; type of roller, type of roller cover; data providing information on the production process, e.g. problems which may have arisen during production or special production steps; production records such as balancing and/or grinding records; data documenting the as-shipped state;

b) Specific Data Concerning the Use of the Roller in the Paper Mill:

roller installation and dismantling dates, e.g. between servicing jobs; installed position(s) of the roller; problems which arose during operation of the roller;

c) Specific Data Concerning Servicing:

type of servicing work carried out, e.g. grinding; production of a new cover (e.g. which type of cover was put on); conversion work carried out;

To prevent marking and trouble when transporting the material web it makes sense for the send unit and/or the at least one data storage unit to be arranged in the edge region of the skin or the press belt or the roller or the roller cover.

Advantageously the sensor unit is constructed as a piezoelectric sensor unit.

According to the method of the present invention for the optimization of the process performance of a web-processing machine, in particular a machine for the production or further processing of paper, paperboard or tissue, provision is made for the following steps: storage of specific data of a component on a data storage unit fitted to the component; and/or measurement of relevant properties of the component by way of a sensor unit fitted to the component; sending of the specific data and/or the measured relevant properties to an open-loop control unit and/or a closed-loop control unit; and optimization of the process performance by way of the open-loop control unit and/or the closed-loop control unit using the specific data and/or the measured properties of the component.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
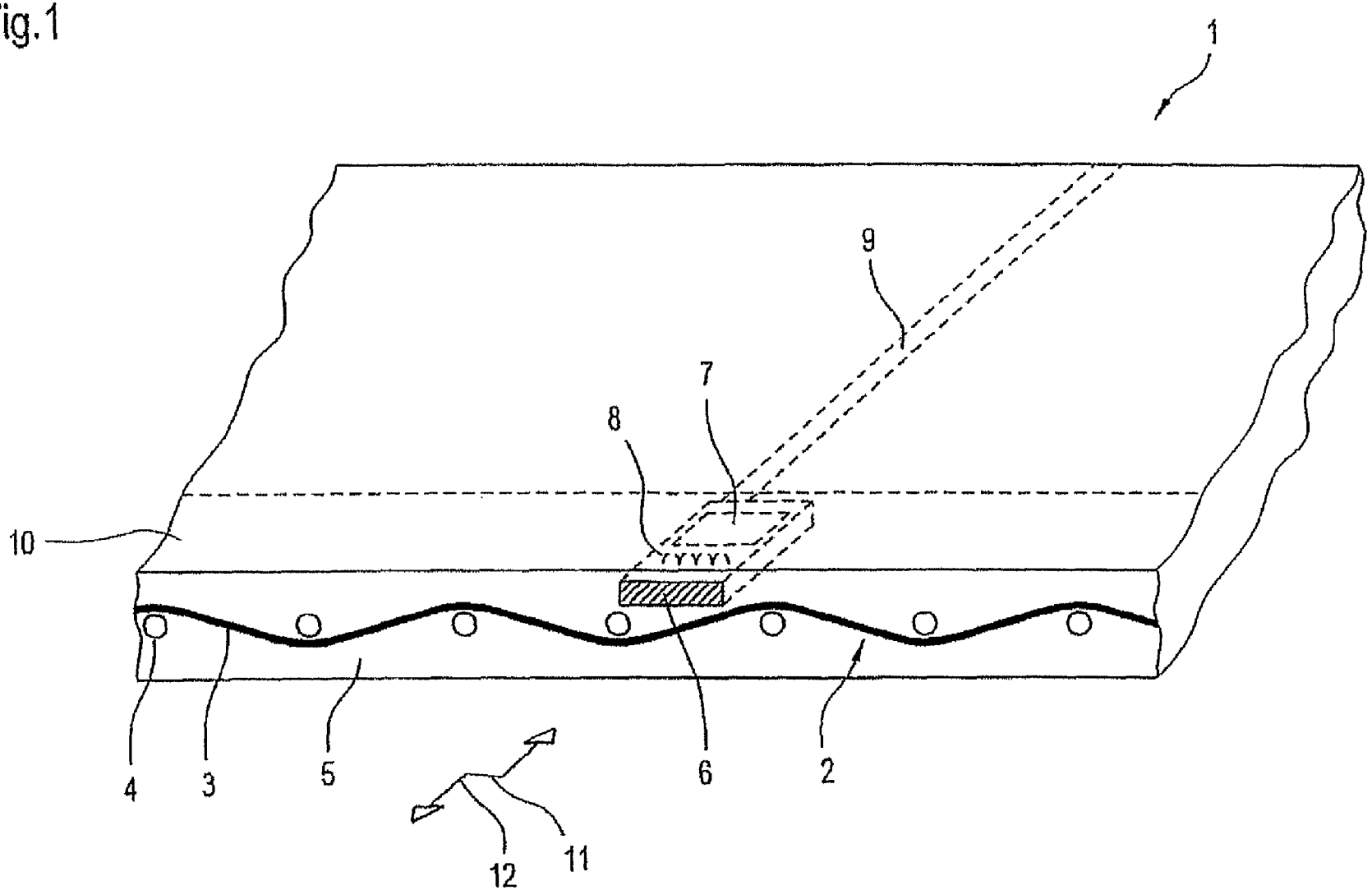
FIG. 1 is an inventive skin of a web-processing machine.

Referring now to the drawings, and more particularly to FIG. 1, there is shown, a perspective representation in sections, an inventive skin in the form of a transfer belt 1. The transfer belt 1 has a supporting structure 2 woven from warp threads 3 and weft threads 4, which is embedded in a thermoplastic shell structure 5 and securely joined to it.

Also embedded in the shell structure 5 is a transponder chip 6. The transponder chip 6 includes a data storage unit 7 and a first send-and-receive unit 8. In the embodiment in question, the data storage unit 7 is constructed as an electronic storage medium. Stored in the data storage unit 7 are specific data 11 of the transfer belt 1, which provide information on the design and/or material and/or date of production and/or date of installation of the transfer belt 1. As is evident from FIG. 1, the transponder chip 6 is arranged in the edge region 10 of the transfer belt 1.

Also embedded in the shell structure 5 is a sensor unit 9 in the form of a piezoelectric fiber 9, by way of which measured values of relevant properties 12, in this case in the form of pressure measurements, of the transfer belt 1 can be produced.

In the embodiment in question, the sensor unit 9 and the data storage unit 7 each communicate with the first send-and-receive unit 8.

Figure 2:
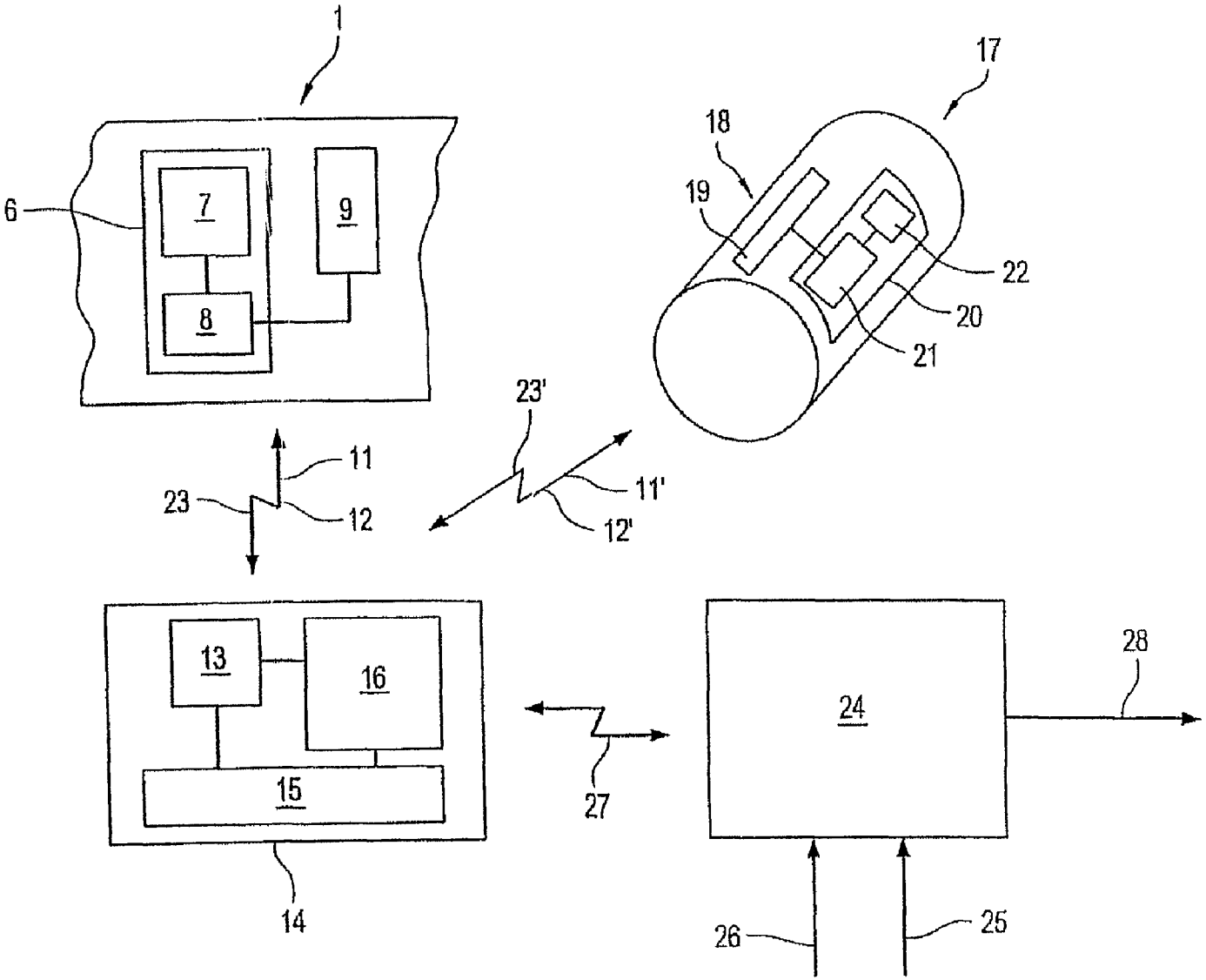
FIG. 2 is a block diagram of an inventive production optimization system.

The first send-and-receive unit 8 then sends the specific data 11 stored in the data storage unit 7 and the measured values of relevant properties 12 to an external evaluation unit 16 via a second send-and-receive unit 13 (represented in FIG. 2).

FIG. 2 shows a block diagram of an inventive production optimization system (POS) 17.

In the embodiment in question the POS 17 is formed by the following components: a transfer belt 1 with an integrated transponder 6 with a data storage unit 7 and a first send-and-receive unit 8, as well as a sensor unit 9 integrated in the transfer belt 1; a roller cover 18 with an integrated sensor unit 19 and an integrated transponder 20 with a data storage unit 22 and a first send-and-receive unit 21; a mobile peripheral 14 with an integrated second send-and-receive unit 13, an input unit 15 and an evaluation unit 16; and an open-loop control unit and/or a closed-circuit control unit 24.

The first send-and-receive unit 8 communicates with the data storage unit 7 and the sensor unit 9 in bidirectional mode, i.e. data exchange in both directions is possible.

Also, the first send-and-receive unit 21 communicates with the data storage unit 22 and the sensor unit 19 in bidirectional mode, i.e. data exchange in both directions is possible.

The first send-and-receive unit 8 sends, by radio transmission, specific data 11 and measured values of relevant properties 12 of the transfer belt 1 to the second send-and-receive unit 13 of the mobile peripheral 14.

Also, the first send-and-receive unit 21 sends, by radio transmission, specific data 11' and measured values of relevant properties 12' of the roller cover 18 to the second send-and-receive unit 13 of the mobile peripheral 14.

The send-and-receive unit 13 sends the received data 11, 11' and measured values 12, 12' to the evaluation unit 16. The evaluation unit 16 produces from the received data 11, 11' and measured values 12, 12' an evaluation signal 27 and sends the evaluation signal 27 to the open-loop control unit and/or the closed-loop control unit 24, which effects an optimization of the process performance/productivity using specific data 11, 11' and/or the measured values 12, 12' of the transfer belt 1 and the roller cover 18 and emits corresponding control signals 28.

In this case the productivity can be increased through an exact and demand-related determination of stoppage times 28 and/or through the determination and coordination of the order of material web grades to be produced. Similarly the productivity can be increased through an optimization of process parameters.

For the optimization of productivity by the open-loop control unit 24, use can be made in addition of information 25 concerning the time of production and grade of the material webs previously produced and/or process parameters 26 of the web-processing machine.

The two data storage units 7 and 22 are re-programmable data storage units. This makes sense in particular when the transponders 6 and 20 are to be re-used after changing the transfer belt or the roller cover for example. The new specific data 23, 23' can then be entered using the input unit 15 of the peripheral 14, for example, and be sent by radio transmission to the respective data storage units 7 and 22.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 Skin (transfer belt)
2 Weave structure
3 Warp thread
4 Weft thread
5 Shell structure
6 Transponder chip
7 Data storage unit
8 First send-and-receive unit
9 Sensor unit
10 Edge region
11 Specific data
12 Measured values
13 Second send-and-receive unit
14 Peripheral
15 Input unit
16 Evaluation unit
17 Production optimization system
18 Roller cover
19 Sensor unit
20 Transponder
21 First send-and-receive unit
22 Data storage unit
23 Specific data
24 Open-loop control unit
25 Information
26 Process parameters
27 Evaluation signal
28 Control signal (optimization signal)

What is claimed is:

1. A production optimization system for a fiber web-processing machine, said system comprising:

at least one of an open-loop control unit and a closed-loop control unit; and at least one data storage unit fitted to at least one component of the fiber web-processing machine, wherein specific data of said component is one of stored and storable on said at least one data storage unit, wherein said at least one of said open-loop control unit and said closed-loop control unit is configured for optimizing a production performance using said specific data, said at least one of said open-loop control unit and said closed-loop control unit being configured for optimizing productivity by determining and coordinating an order of the material web grades to be produced through use of said specific data of said at least one component, said component being removable for replacement after being worn out.

2. A production optimization system according to claim 1, wherein said at least one of said open-loop control unit and said closed-loop control unit is configured for optimizing productivity by determining stoppage times.

3. A production optimization system according to claim 1, wherein said at least one of said open-loop control unit and said closed-loop control unit is configured for optimizing productivity through the adjustment of a plurality of process parameters of the web-processing machine.

4. A production optimization system according to claim 1, wherein said at least one of said open-loop control unit and said closed-loop control unit is configured for optimizing productivity at least one of through the use of information concerning at least one of a time of production, a grade, a plurality of properties, and a quality of a plurality of material webs produced and through the use of a plurality of process parameters of the web-processing machine.

5. A production optimization system according to claim 1, further comprising an evaluation unit, wherein the system is configured for sending said specific data from said at least one data storage unit to said evaluation unit, said evaluation unit configured for sending evaluated data based on received said specific data from said evaluation unit to said at least one of said open-loop control and said closed-loop control unit.

6. A production optimization system according to claim 5, wherein said evaluation unit is an external unit in relation to the web-processing machine.

7. A production optimization system according to claim 5, wherein said evaluation unit and said at least one of said open-loop control unit and said closed-loop control unit form one integral unit.

8. A production optimization according to claim 5, further comprising at least one first send-and-receive unit and one second send-and-receive unit, wherein said at least one data storage unit is connected to said at least one first send-and-receive unit, said evaluation unit connected to said second send-and-receive unit, and said at least first and said second send-and-receive units configured for communicating with each other.

9. A production optimization system according to claim 8, wherein at least said at least first and said second send-and-receive units are configured for having wireless communication with each other.

10. A production optimization system according to claim 9, wherein said wireless communication is effected using one of Radio Frequency Identification technology and a Bluetooth standard.

11. A production optimization system according to claim 8, wherein said at least one first send-and-receive unit is integrated in said component.

12. A production optimization system according to claim 8, further comprising a chip, wherein said at least one data storage unit and said at least one first send-and-receive unit are each an integral part of said chip.

13. A production optimization system according to claim 12, wherein said component is one of a skin, a press belt, and a roller, said chip arranged at the edge of one of said skin, said press belt, and said roller.

14. A production optimization system according to claim 13, wherein said roller includes a region of a roller cover, said chip arranged at the edge of said region of said roller cover.

15. A production optimization system according to claim 8, further comprising one of a stationary and a mobile peripheral including an input unit, wherein said second send-and-receive unit and said evaluation unit are each an integral part of said peripheral.

16. A production optimization system according to claim 15, wherein said at least one data storage unit is programmable by said input unit.

17. A production optimization system according to claim 1, said component is a wearing part of the web-processing machine.

18. A production optimization system according to claim 17, wherein said wearing part is one of a skin, a press belt, a roller, and a roller cover.

19. A production optimization system according to claim 1, wherein said specific data provide information on at least one of a design, a material, a date of production, and a date of installation of said component.

20. A production optimization system according to claim 1, wherein said at least one data storage unit is integrated in said component.

21. A production optimization system for a fiber web-processing machine, said system comprising:

at least one of an open-loop control unit and a closed-loop control unit; and at least one sensor unit fitted to at least one component of the fiber web-processing machine, wherein a plurality of relevant properties of said component is measurable by said at least one sensor unit, wherein said at least one of said open-loop control unit and said closed-loop control unit is configured for optimizing a production performance using a measured said plurality of relevant properties, said at least one of said open-loop control unit and said closed-loop control unit being configured for optimizing productivity by determining and coordinating an order of the material web grades to be produced through use of specific data of said at least one component, said component being removable for replacement after being worn out.

22. A production optimization system according to claim 21, wherein said at least one of said open-loop control unit and said closed-loop control unit is configured for optimizing productivity at least one of by determining stoppage times and by determining and coordinating an order of the material web grades to be produced through use of said measured plurality of relevant properties of said at least one component.

23. A production optimization system according to claim 21, further comprising an evaluation unit, wherein the system is configured for sending said measured plurality of relevant properties from said at least one sensor unit to said evaluation unit, said evaluation unit configured for sending evaluated data based on received said measured plurality of relevant properties from said evaluation unit to said at least one of said open-loop control and said closed-loop control unit.

24. A production optimization according to claim 23, further comprising at least one first send-and-receive unit and one second send-and-receive unit, wherein said at least one sensor unit is connected to said at least one first send-and-receive unit, said evaluation unit connected to said second send-and-receive unit, and said at least first and said second send-and-receive units configured for communicating with each other.

25. A production optimization system according to claim 21, wherein said measured plurality of relevant properties provide information on at least one of a wear, a state, and a remaining life of said component.

26. A production optimization system according to claim 21, said at least one sensor unit is integrated in said component.

27. A method for optimization of the process performance of a fiber web-processing machine, said method comprising the steps of:

at least one of storing specific data of a component on a data storage unit fitted to said component and measuring a plurality of relevant properties of said component by a sensor unit fitted to said component;

sending at least one of said specific data and a measured said plurality of relevant properties to at least one of an open-loop control unit and a closed-loop control unit; and optimizing the process performance by at least one of said open-loop control unit and said closed-loop control unit using at least one of said specific data and said measured plurality of relevant properties of said component, said at least one of said open-loop control unit and said closed-loop control unit optimizing productivity by determining and coordinating an order of the material web grades to be produced through use of said specific data of said component, said component being removable for replacement after being worn out.

* * * * *